US011482798B2

(12) United States Patent
Onuma et al.

(10) Patent No.: US 11,482,798 B2
(45) Date of Patent: Oct. 25, 2022

(54) TERMINAL-EQUIPPED ELECTRIC WIRE WITH EXPOSED WIRE HAVING INSULATIVE SHEATH COVERING END PART CRIMPED AND PROTECTED WITH ANTICORROSIVE MATERIAL

(71) Applicant: Yazaki Corporation, Tokyo (JP)

(72) Inventors: Masanori Onuma, Shizuoka (JP); Hidehiko Iwasawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/199,354

(22) Filed: Mar. 11, 2021

(65) Prior Publication Data

US 2021/0296793 A1 Sep. 23, 2021

(30) Foreign Application Priority Data

Mar. 18, 2020 (JP) ..... JP2020-047496

(51) Int. Cl.

| | |
|---|---|
| ***H01R 4/18*** | (2006.01) |
| ***H01R 4/70*** | (2006.01) |
| ***H01B 7/28*** | (2006.01) |
| ***H01R 43/048*** | (2006.01) |

(52) U.S. Cl.

CPC ..... *H01R 4/185* (2013.01); *H01B 7/2806* (2013.01); *H01R 4/70* (2013.01); *H01R 43/048* (2013.01)

(58) Field of Classification Search

CPC ..... H01R 4/185; H01R 4/70; H01R 43/048; H01B 7/2806

USPC ..... 439/877

See application file for complete search history.

(56) References Cited

U.S. PATENT DOCUMENTS

| | | | | |
|---|---|---|---|---|
| 7,160,150 | B2 * | 1/2007 | Annequin | H01R 43/048 439/585 |
| 8,177,591 | B2 * | 5/2012 | Okamura | H01R 4/188 439/877 |
| 8,210,884 | B2 * | 7/2012 | Corman | H01R 4/185 439/877 |
| 8,360,803 | B2 * | 1/2013 | Sakai | H01R 43/005 439/523 |

(Continued)

FOREIGN PATENT DOCUMENTS

| | | | | |
|---|---|---|---|---|
| DE | 102013205235 | A1 * | 9/2014 | H01R 4/185 |
| EP | 1796216 | A1 * | 6/2007 | H01R 11/12 |

(Continued)

*Primary Examiner* — Peter G Leigh
(74) *Attorney, Agent, or Firm* — Kenealy Vaidya LLP

(57) ABSTRACT

A terminal-equipped electric wire includes: an electric wire in which a conductor is covered by an insulating cover; a crimp terminal including a conductor crimping portion crimped to the conductor exposed from an end of the insulating cover, a cover crimping portion crimped to the insulating cover, and an intermediate portion that couples the conductor crimping portion and the cover crimping portion and in which the conductor is exposed; and a anticorrosive material covering at least the conductor exposed in the intermediate portion. The intermediate portion has grooves that are provided on a surface on the conductor side and formed from both end portions in a circumferential direction such that each of the grooves is formed toward a center side in the circumferential direction.

8 Claims, 10 Drawing Sheets

(56) References Cited

U.S. PATENT DOCUMENTS

| | | | | |
|---|---|---|---|---|
| 8,616,928 | B2 * | 12/2013 | Uchiyama | H01R 4/184 439/877 |
| 9,039,467 | B2 * | 5/2015 | Seipel | H01R 4/185 439/877 |
| 9,083,100 | B2 * | 7/2015 | Uno | H01R 43/24 |
| 9,112,290 | B2 * | 8/2015 | Matsushita | H01R 4/62 |
| 9,209,615 | B2 * | 12/2015 | Ono | H01R 4/70 |
| 9,325,085 | B2 * | 4/2016 | Tanaka | H01R 43/28 |
| 9,543,689 | B2 * | 1/2017 | Sato | H01R 13/5213 |
| 9,570,870 | B2 * | 2/2017 | Kawamura | H01R 4/187 |
| 9,768,524 | B2 * | 9/2017 | Seipel | H01R 4/188 |
| 9,853,368 | B2 * | 12/2017 | Myer | H01R 4/188 |
| 10,355,373 | B2 * | 7/2019 | Iwasawa | H01R 4/70 |
| 10,381,794 | B2 * | 8/2019 | Saito | H01R 43/058 |
| 10,498,048 | B2 * | 12/2019 | Washio | H01R 43/048 |
| 2013/0130565 | A1 * | 5/2013 | Onuma | H01R 4/18 439/877 |
| 2015/0255892 | A1 * | 9/2015 | Bluemmel | H01R 4/62 29/882 |
| 2017/0077618 | A1 * | 3/2017 | Tago | H01R 4/185 |
| 2017/0324172 | A1 * | 11/2017 | Myer | H01R 4/185 |
| 2018/0375225 | A1 * | 12/2018 | Ito | H01R 4/20 |
| 2018/0375275 | A1 * | 12/2018 | Onuma | H01R 43/005 |
| 2019/0013595 | A1 * | 1/2019 | Iwata | H01R 4/188 |

FOREIGN PATENT DOCUMENTS

| | | | | | |
|---|---|---|---|---|---|
| JP | 2008-305571 | A | | 12/2008 | |
| JP | 2010080193 | A | * | 4/2010 | |
| JP | 2010198776 | A | * | 9/2010 | |
| JP | 2011-192530 | A | | 9/2011 | |
| JP | 2012124100 | A | * | 6/2012 | |
| JP | 2015153716 | A | * | 8/2015 | |
| JP | 2015153721 | A | * | 8/2015 | |
| JP | 2017208211 | A | * | 11/2017 | |
| JP | 2019-175791 | A | | 10/2019 | |
| WO | WO-2010024032 | A1 | * | 3/2010 | H01R 4/185 |
| WO | WO-2012043793 | A1 | * | 4/2012 | H01R 4/18 |
| WO | WO-2012165571 | A1 | * | 12/2012 | H01R 13/40 |

* cited by examiner

TERMINAL-EQUIPPED ELECTRIC WIRE WITH EXPOSED WIRE HAVING INSULATIVE SHEATH COVERING END PART CRIMPED AND PROTECTED WITH ANTICORROSIVE MATERIAL

CROSS-REFERENCE TO RELATED APPLICATION(S)

The present application claims priority to and incorporates by reference the entire contents of Japanese Patent Application No. 2020-047496 filed in Japan on Mar. 18, 2020.

BACKGROUND OF THE INVENTION

1. Field of the Invention

The present invention relates to a terminal-equipped electric wire.

2. Description of the Related Art

As an example of techniques applied to conventional terminal-equipped electric wires, Japanese Patent Application Laid-open No. 2019-175791 discloses a terminal-equipped electric wire in which a covered wire and a terminal are connected. The covered wire includes a covering portion and a wire exposed from a distal end of the covering portion. The terminal has a terminal body and a crimping portion. The crimping portion includes a wire crimping portion to which the wire is crimped, a cover crimping portion to which the covering portion is crimped, and a barrel spacing portion between the wire crimping portion and the cover crimping portion. A portion from the barrel spacing portion to the wire crimping portion, in which the wire is exposed, is covered with a anticorrosive material.

The terminal-equipped electric wire described in Japanese Patent Application Laid-open No. 2019-175791, however, has room for further improvement to ensure more appropriate anticorrosion performance, for example.

SUMMARY OF THE INVENTION

In view of such a circumstance, the invention is made and aims to provide a terminal-equipped electric wire that can ensure appropriate anticorrosion performance.

In order to achieve the above mentioned object, a terminal-equipped electric wire according to one aspect of the present invention includes an electric wire in which a conductor having conductivity is covered by an insulating cover having insulation property; a crimp terminal including a conductor crimping portion crimped to the conductor exposed from an end of the insulating cover, a cover crimping portion crimped to the insulating cover, and an intermediate portion that couples the conductor crimping portion and the cover crimping portion and in which the conductor is exposed; and a anticorrosive material covering at least the conductor exposed in the intermediate portion, wherein the intermediate portion has grooves that are provided on a surface on the conductor side and formed from both end portions in a circumferential direction around an axial line of the electric wire such that each of the grooves is formed toward a center side in the circumferential direction.

According to another aspect of the present invention, in the terminal-equipped electric wire, it is possible to configure that the groove extends from the end portion in the circumferential direction of the intermediate portion along the circumferential direction and closes at such a position that an end portion on the center side in the circumferential direction is positioned to be spaced apart from the center in the circumferential direction.

According to still another aspect of the present invention, in the terminal-equipped electric wire, it is possible to configure that the groove is formed in a tapered shape toward the center side in the circumferential direction.

According to still another aspect of the present invention, in the terminal-equipped electric wire, it is possible to configure that the groove is positioned to be apart from the cover crimping portion along the axial line direction of the electric wire.

According to still another aspect of the present invention, in the terminal-equipped electric wire, it is possible to configure that the anticorrosive material is filled in at least a gap space surrounded by the intermediate portion, the conductor, and the end of the insulating cover in a state where the crimp terminal is crimped to the electric wire, and the groove.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes embodiments according to the invention in detail with reference to the accompanying drawings. The embodiments do not limit the invention. The constituent elements described in the following embodiments include those easily envisaged by those skilled in the art or substantially identical ones.

Figure 5:
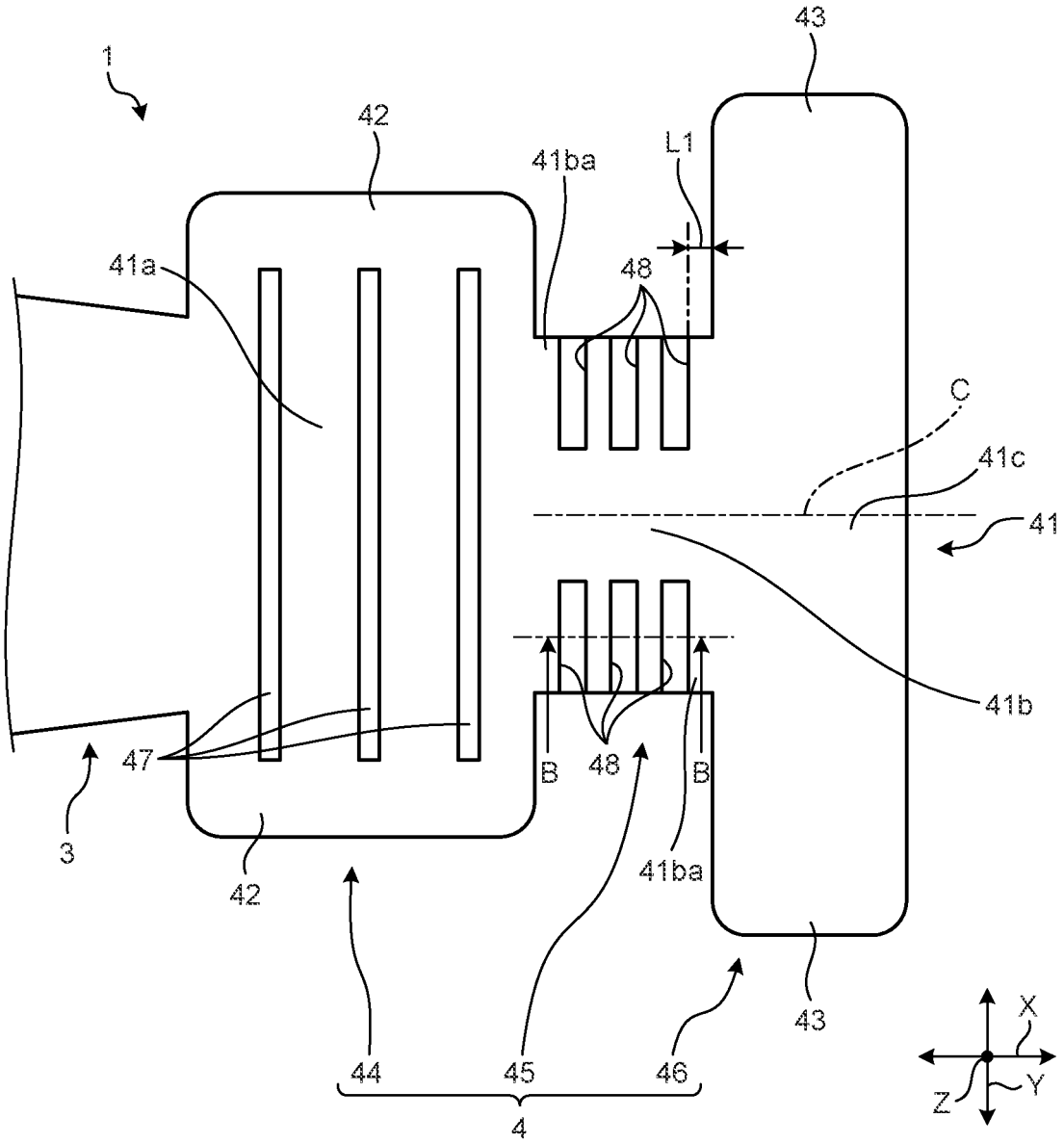
FIG. 5 is a schematic partial plan view of the crimp terminal included in the terminal-equipped electric wire according to the first embodiment in a development state before crimping.
Figure 6:
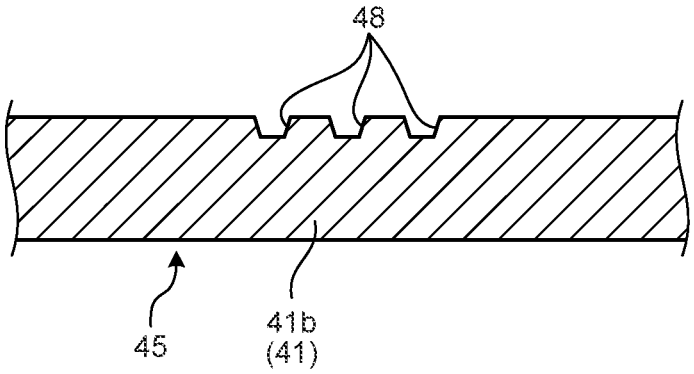
FIG. 6 is a schematic sectional view taken along B-B in FIG. 5.

In the following description, first, second, and third directions intersecting with one another are described as follows: the first direction is an "axial line direction X", the second direction is a "width direction Y", and the third direction is a "height direction Z". The axial line direction X, the width direction Y, and the height direction Z are substantially orthogonal to one another. The axial line direction X typically corresponds to a direction along an axial line X1 (refer to FIG. 1, for example) of an electric wire to which a crimp terminal is provided, an extending direction of the electric wire, and an insertion-extraction direction between the crimp terminal and a mating terminal, for example. The width direction Y and the height direction Z correspond to an intersecting direction that intersects the axial line direction X. In the following description, a direction around the axial line X1 in a state after crimping of the crimp terminal is described as a "circumferential direction D1". FIGS. 1, 4, 9, and 11 illustrate states before crimping of the crimp terminal. FIGS. 2, 3, 7, 8, 10, and 13 illustrate states after crimping of the crimp terminal. FIGS. 5, 6, and 12 illustrate a development state where the crimp terminal is not crimped to the electric wire and an electric wire crimping portion of the crimp terminal is developed in a plate-like shape. Each direction used in the following description represents the direction in a state where certain portions are assembled one another unless otherwise specified.

First Embodiment

Figure 1:
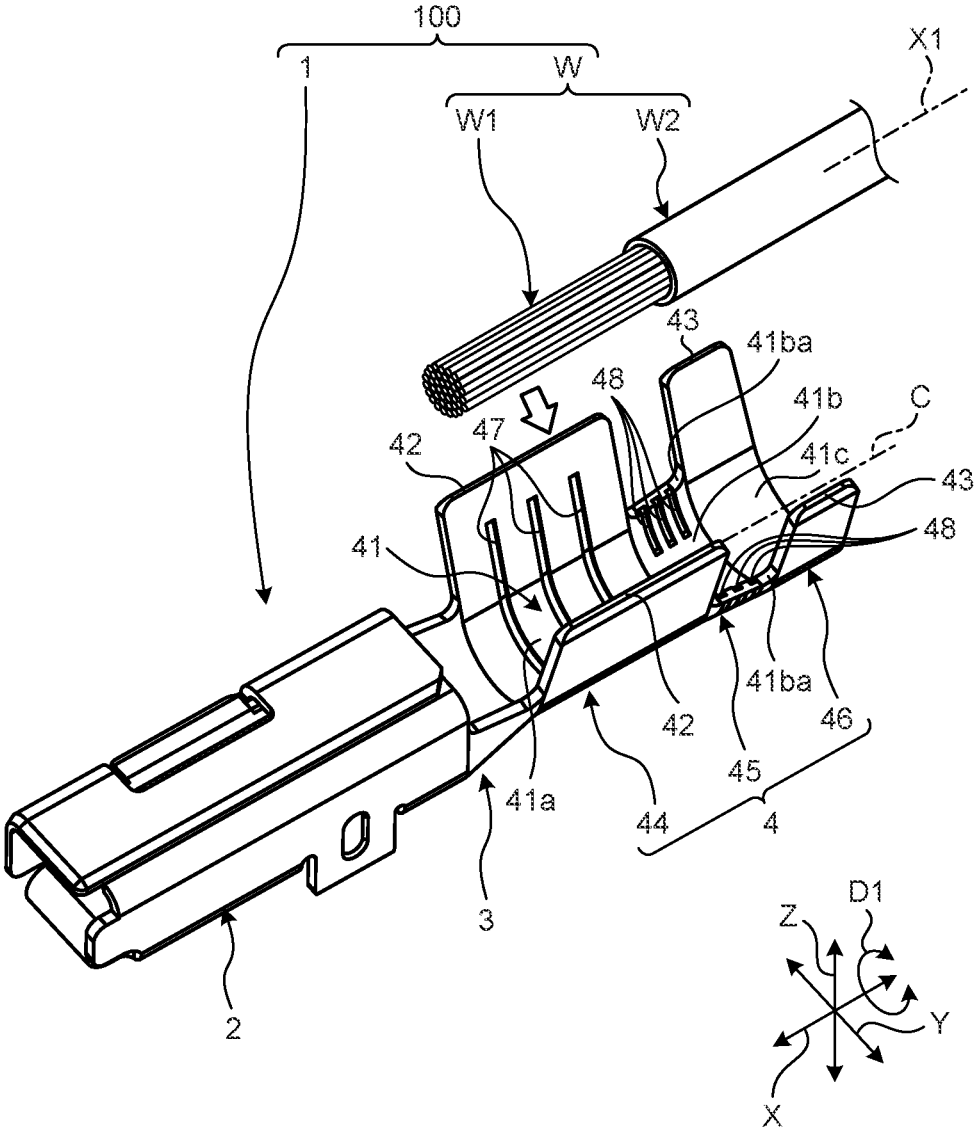
FIG. 1 is an exploded perspective view illustrating a rough structure of a terminal-equipped electric wire according to a first embodiment.
Figure 2:
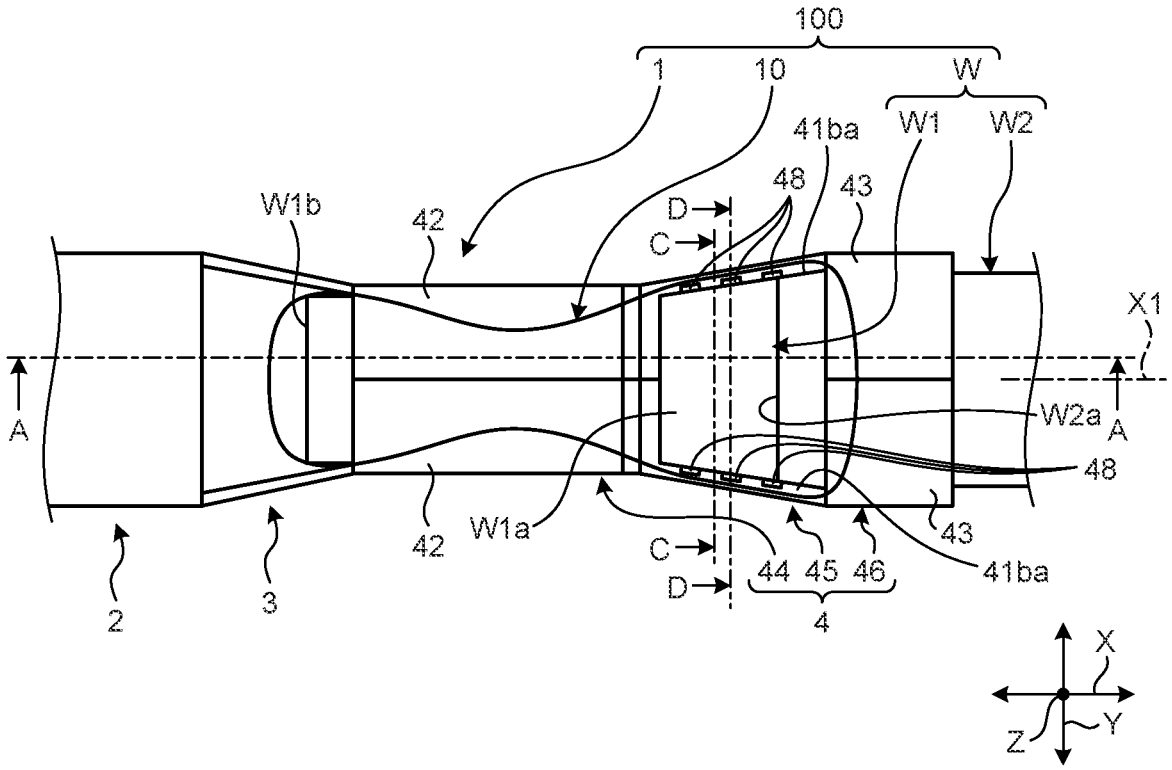
FIG. 2 is a schematic partial plan view illustrating the rough structure of the terminal-equipped electric wire according to the first embodiment.
Figure 3:
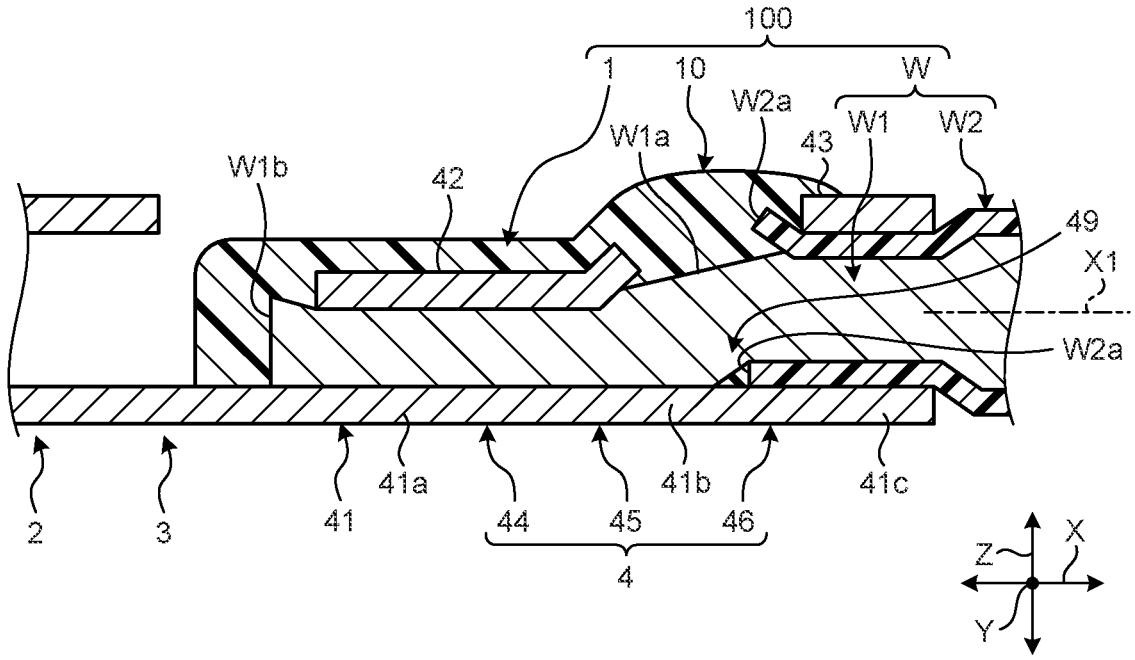
FIG. 3 is a schematic sectional view taken along A-A in FIG. 2.
Figure 4:
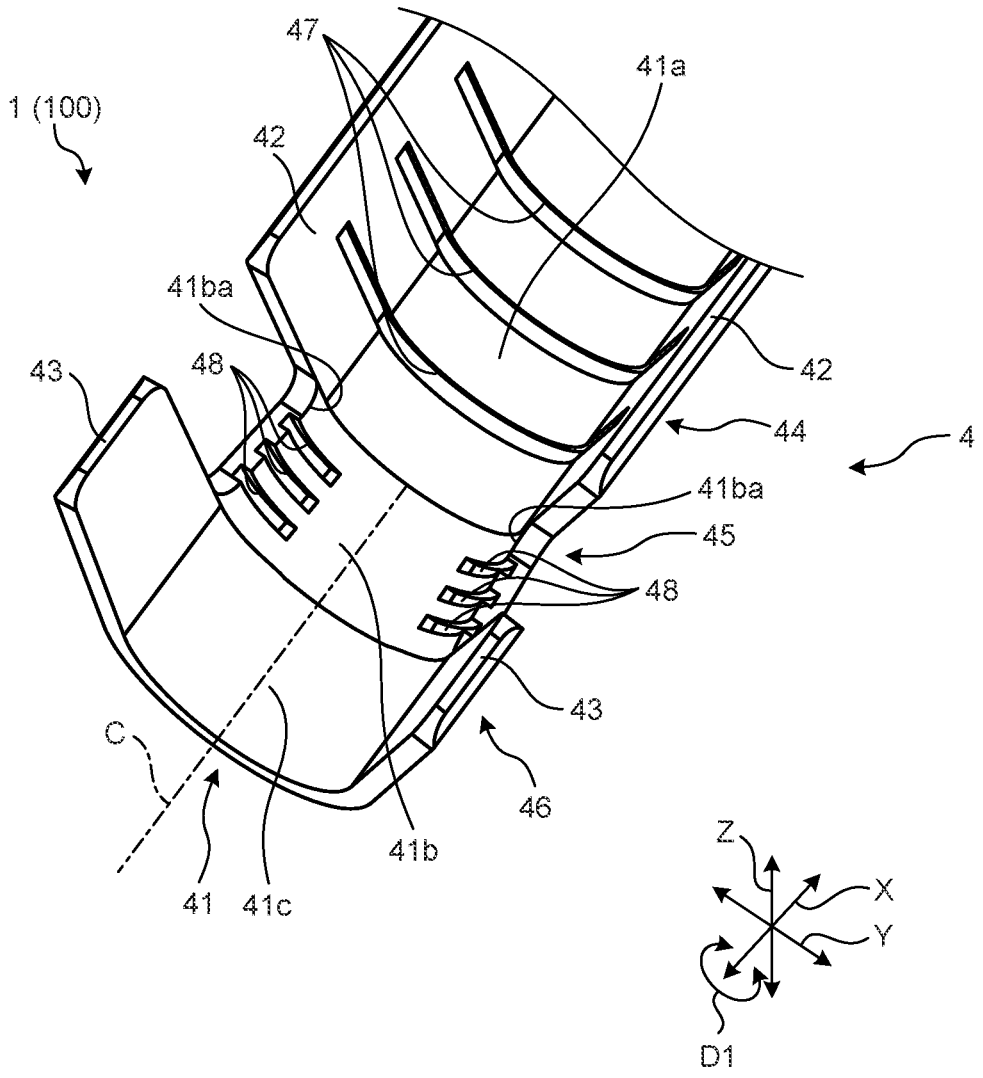
FIG. 4 is a partial perspective view including grooves of a crimp terminal included in the terminal-equipped electric wire according to the first embodiment.

A terminal-equipped electric wire 100 in a first embodiment illustrated in FIGS. 1, 2, and 3 is applied to wire harnesses used for vehicles, for example. The wire harnesses, which are used for establishing connection among devices mounted on a vehicle, for example, bundle a plurality of electric wires W used for power supply and signal communication to serve as collective components and connect the electric wires W to the corresponding devices with connectors, for example.

The terminal-equipped electric wire 100 in the first embodiment includes the electric wire W, a crimp terminal 1 that is crimped and conductively connected to the end of the electric wire W, and a anticorrosive material 10 that covers certain portions to perform corrosion prevention (refer to FIGS. 2 and 3). The crimp terminal 1 in the embodiment is a anticorrosive terminal prevented from corrosion with the anticorrosive material 10. The terminal-equipped electric wire 100 in the embodiment ensures appropriate anticorrosion performance by grooves 48 provided to the crimp terminal 1. The following describes the structure of the terminal-equipped electric wire 100 in detail with reference to the drawings.

The electric wires W are routed in a vehicle to electrically connect various devices. The electrical wire W includes a wire-shaped conductor W1 having conductivity and an insulating cover W2 that covers an exterior of the conductor W1 and has insulation property. The electric wire W is an insulated wire in which the insulating cover W2 covers the conductor W1.

The conductor W1 is a core wire formed by bundling a plurality of metal element wires having conductor. The conductor W1 may be a twisted core wire formed by twisting the multiple metal element wires. The insulating cover W2 is an electric wire cover that covers an outer circumferential side of the conductor W1. The insulating cover W2 is formed by extrusion molding of an insulating resin material such as polypropylene (PP), polyvinyl chloride (PVC), or cross-linked polyethylene (PE), which is appropriately selected taking into consideration of abrasion resistance, chemical resistance, and heat resistance, for example.

The electric wire W is formed in such a manner to extend in a wire shape along the axial line X1 and to have a substantially identical diameter in the extending direction (the axial line direction X). The sectional shape (sectional shape in a direction intersecting the axial line direction X) of the conductor W1 is a substantially circular shape. The sectional shape of the insulating cover W2 is a substantially circular ring shape. The electric wire W, thus, has a sectional shape of a substantially circular shape as a whole. At at least one end of the electric wire W, the insulating cover W2 is stripped, thereby causing the conductor W1 to be exposed from the insulating cover W2. The crimp terminal 1 is provided to the end of the conductor W1 exposed from the insulating cover W2 of the electric wire W.

The crimp terminal 1 is a terminal metal to which the electric wire W is electrically connected and the mating terminal having conductivity is connected. The crimp terminal 1 includes an electric connection portion 2, a coupling portion 3, and an electric wire crimping portion 4. The electric connection portion 2, the coupling portion 3, and the electric wire crimping portion 4 are made of a metallic member having conductivity in such a manner to be integrated as a whole. For example, the crimp terminal 1 is formed by performing various types of processing such as punching processing, press processing, and bending processing on a single sheet metal according to shapes corresponding to portions such as the electric connection portion 2, the coupling portion 3, and the electric wire crimping portion 4, resulting in the portions being three-dimensionally and integrally formed. In the crimp terminal 1, the electric connection portion 2, the coupling portion 3, and the electric wire crimping portion 4 are juxtaposed in this order from one side toward the other side along the axial line direction X to be interconnected.

The electric connection portion 2 is electrically connected to the mating terminal. The electric connection portion 2 may have a male type shape or a female type shape. The electric connection portion 2 in the embodiment has a female type shape as illustrated and is electrically connected to the mating terminal having a male type shape. The electric connection portion 2 is not limited to be electrically connected to the mating terminal, and may be electrically connected to various conductive members such as a grounding member. In this case, the electric connection portion 2 may have a shape of what is called a ring terminal (LA terminal) fastened to the grounding member, for example.

The coupling portion 3, which is interposed between the electric connection portion 2 and the electric wire crimping portion 4, couples the electric connection portion 2 and the electric wire crimping portion 4 to establish conduction therebetween. In the crimp terminal 1, the electric connection portion 2 and the electric wire crimping portion 4 are electrically connected via the coupling portion 3, and the electric connection portion 2 and the conductor W1 of the electric wire W are electrically connected via the electric wire crimping portion 4.

The electric wire crimping portion 4, to which the electric wire W is connected, electrically connects the end of the electric wire W and the crimp terminal 1. The electric wire crimping portion 4 is provided on the end of the electric wire W by being swaged and crimped to the end of the electric wire W. The electric wire crimping portion 4 includes a base 41 and two pairs of barrel pieces 42 and 43. The electric wire crimping portion 4 is crimped to the electric wire W by swaging of the base 41 and the two pairs of barrel pieces 42 and 43.

More specifically, the base 41 and the two pairs of barrel pieces 42 and 43 of the electric wire crimping portion 4 form a conductor crimping portion 44, an intermediate portion 45, and a cover crimping portion 46. In other words, the electric wire crimping portion 4 includes the conductor crimping portion 44, the intermediate portion 45, and the cover crimping portion 46 that are formed by the base 41 and the two pairs of barrel pieces 42 and 43.

The conductor crimping portion 44 is formed by a part of the base 41 and the pair of barrel pieces 42. The intermediate portion 45 is formed by another part of the base 41. The cover crimping portion 46 is formed by the other part of the base 41 and the pair of barrel pieces 43. In the electric wire crimping portion 4, the conductor crimping portion 44, the intermediate portion 45, and the cover crimping portion 46 are juxtaposed in this order from the electric connection portion 2 side toward the opposite side along the axial line direction X to be interconnected. The electric wire crimping portion 4 in the embodiment is what is called an isolated barrel type crimping portion in which the pair of barrel pieces 42 and the pair of barrel pieces 43 are isolated with the intermediate portion 45 interposed therebetween.

Specifically, the base 41 extends along the axial line direction X and serves as a bottom wall of the electric wire crimping portion 4 formed in a substantially U-shape in a state before crimping of the crimp terminal 1. The base 41 is formed in such a plate-like shape that its thickness direction is along the height direction Z. On the base 41, the end portion of the electric wire W is placed in the crimping processing. On one side in the axial line direction X of the base 41, the electric connection portion 2 is coupled with the coupling portion 3 interposed therebetween. Both end portions in the width direction Y of the base 41 stand along the height direction Z at each portion.

More specifically, the base 41 continues along the axial line direction X across the conductor crimping portion 44, the intermediate portion 45, and the cover crimping portion 46. The base 41 is composed of a first base 41*a* forming the conductor crimping portion 44, a second base 41*b* forming the intermediate portion 45, and a third base 41*c* forming the cover crimping portion 46 that continue along the axial line direction X. To one end portion in the axial line direction X of the first base 41*a* of the base 41, the electric connection portion 2 is coupled. In a state before the crimping processing, to the other end portion in the axial line direction X of the third base 41*c* of the base 41, a carrier is coupled. The base 41 is cut from the carrier in the crimping processing, for example.

The pair of barrel pieces 42 form the conductor crimping portion 44 together with the first base 41*a*, which is a part of the base 41. The conductor crimping portion 44 is swaged and crimped to the conductor W1 of the electric wire W, thereby being electrically connected to the conductor W1. The conductor crimping portion 44 is provided on one end side in the axial line direction X, that is, on the electric connection portion 2 side, of the electric wire crimping portion 4.

The pair of barrel pieces 42 are formed in such a manner to extend from the first base 41*a* of the conductor crimping portion 44 on both sides in the width direction Y in a belt-like shape, and are swaged and crimped while the pair of barrel pieces 42 and the first base 41*a* wrap conductor W1 of the electric wire W. The pair of barrel pieces 42 serve as a side wall of the electric wire crimping portion 4 formed in a U-shape in a state before the crimping processing. One barrel piece 42 extends on one side in the width direction Y from the first base 41*a*. The other barrel piece 42 extends on the other side in the width direction Y from the first base 41*a*. In a state where the pair of barrel pieces 42 are not swaged and crimped to the conductor W1 of the electric wire W, bending processing is performed on the first base 41*a* to be formed in a substantially U-shape together with the first base 41*a*.

For the pair of barrel pieces 42 in the embodiment, the length from a root on the first base 41*a* side to the distal end of each barrel piece 42 is set such that the pairs of barrel pieces 42 are not layered (not overlapped) each other in a state where the pair of barrel pieces 42 are wound to be swaged and crimped to the conductor W1. The conductor crimping portion 44 is crimped to the conductor W1 by swaging of the first base 41*a* and the pair of barrel pieces 42 while wrapping the exterior of the conductor W1 of the electric wire W disposed between the pair of barrel pieces 42.

The pair of barrel pieces 42 in the embodiment are subjected to swaging and crimping what is called B crimp. In the conductor crimping portion 44 in B crimp, each of the pair of barrel pieces 42 is bent toward the first base 41*a* side in a crimped state while the first base 41*a* and the pair of barrel pieces 42 wrap the conductor W1. Then, the conductor crimping portion 44 is swaged such that the distal ends of the pair of barrel pieces 42 are each brought contact with and pushed against the conductor W1, and crimped.

The conductor crimping portion 44 may have a plurality of serrations 47 on portions in contact with the conductor W1 of the first base 41*a* and the pair of barrel pieces 42 for increasing an area in contact with the conductor W1 to improve contact stability and for increasing adhesion strength, for example. The serrations 47 are formed in a recessed shape on a surface on the conductor W1 side (i.e., an inner surface) of the conductor crimping portion 44. The serrations 47 are formed along the circumferential direction D1 across the first base 41*a*, and the pair of barrel pieces 42.

The pair of barrel pieces 43 form the cover crimping portion 46 together with the third base 41*c*, which is a part of the base 41. The cover crimping portion 46 is swaged and crimped to the insulating cover W2 of the electric wire W, thereby being fixed to the insulating cover W2. The cover crimping portion 46 is provided on the other end side in the axial line direction X, that is, on the side opposite to the electric connection portion 2 side, of the electric wire crimping portion 4.

The pair of barrel pieces 43 are formed in such a manner to extend from the third base 41*c* of the cover crimping portion 46 on both sides in the width direction Y in a belt-like shape, and are swaged and crimped while the pair of barrel pieces 43 and the third base 41*c* wrap the insulating cover W2 of the electric wire W. The pair of barrel pieces 43 serve as the side wall of the electric wire crimping portion 4 formed in a U-shape in a state before the crimping processing. One barrel piece 43 extends on one side in the width direction Y from the third base 41*c*. The other barrel piece 43 extends on the other side in the width direction Y from the third base 41*c*. In a state where the pair of barrel pieces 43 are not swaged and crimped to the insulating cover W2 of the electric wire W, bending processing is performed on the third base 41*c* to be formed in a substantially U-shape together with the third base 41*c*.

For the pair of barrel pieces 43 in the embodiment, the length from a root on the third base 41*c* side to the distal end of each barrel piece 43 is set such that the pairs of barrel pieces 43 are not layered (not overlapped) each other in a state where the pair of barrel pieces 43 are wound to be swaged and crimped to the insulating cover W2. The cover crimping portion 46 is crimped to the insulating cover W2 by swaging of the third base 41*c* and the pair of barrel pieces 43 while wrapping the exterior of the insulating cover W2 of the electric wire W disposed between the pair of barrel pieces 43.

The pair of barrel pieces 43 in the embodiment are subjected to swaging and crimping what is called round crimp. The cover crimping portion 46 are swaged and crimped in such a positional relation that the distal ends of the pair of barrel pieces 43 face each other in a crimped state while the third base 41*c* and the pair of barrel pieces 43 wrap the insulating cover W2.

In the electric wire crimping portion 4, the intermediate portion 45 is interposed between the cover crimping portion 46 and the conductor crimping portion 44 in the axial line direction X. The intermediate portion 45, which is interposed between the conductor crimping portion 44 and the cover crimping portion 46, couples the conductor crimping portion 44 and the cover crimping portion 46. The intermediate portion 45 is formed by the second base 41*b*. The first base 41*a* of the conductor crimping portion 44 is coupled to the end portion on one side in the axial line direction X of the second base 41*b* while the third base 41*c* of the cover crimping portion 46 is coupled to the end portion on the other side in the axial line direction X of the second base 41*b*. The intermediate portion 45 is a portion in which an intermediate exposed portion W1*a* of the conductor W1 is exposed. As described above, the pair of barrel pieces 42 and the pair of barrel pieces 43 are formed in such a manner to be isolated with an interval therebetween due to the intermediate portion 45 interposed therebetween.

The crimp terminal 1 thus structured is crimped to the end of the electric wire W as a result of the conductor crimping portion 44 being crimped to the conductor W1 and the cover crimping portion 46 being crimped to the insulating cover W2. In the crimp terminal 1 in this state, a contact portion is formed between the conductor crimping portion 44 and the conductor W1, resulting in the crimp terminal 1 being conductively connected to the conductor W1 of the electric wire W via the contact portion. The crimp terminal 1 is held by a connector housing, for example. The connector housing and a connector housing of the mating connector are mutually fitted as a connector joint. As a result, the crimp terminal 1 is electrically connected to the mating terminal to form an electric contact portion therebetween. This results in the crimp terminal 1 being conductively connected to the mating terminal via the connection portion.

The conductor W1, to which the crimp terminal 1 is crimped, of the electric wire W is made of aluminum (Al) or an aluminum alloy, for example, in sometimes. In this case, the conductor W1 is the core wire formed by bundling a plurality of metal element wires made of aluminum or an aluminum alloy. The crimp terminal 1 is made of a base metal made of dissimilar metal, such as copper (Cu) or a copper alloy, different from that of the conductor W1 and a surface of the base metal is plated with tin (Sn), for example, in sometimes. In this case, the terminal-equipped electric wire 100, in which the material of the conductor W1 is aluminum or an aluminum alloy while the material of the crimp terminal 1 is copper or a copper alloy, has a risk of occurrence of galvanic corrosion between the conductor W1 and the crimp terminal 1 when water (salt water) intrudes therebetween due to a difference in ionization tendency between them. The aluminum alloy is an alloy containing aluminum as a main component. The copper alloy is an alloy containing copper as a main component. For example, the copper alloy is what is called brass.

The crimp terminal 1 in which the anticorrosive material 10 preventing corrosion is applied to the electric wire crimping portion 4, however, prevents the occurrence of the galvanic corrosion. The crimp terminal 1 in the embodiment is prevented from corrosion by covering at least the intermediate exposed portion W1*a*, which is exposed in the intermediate portion 45, of the conductor W1 with the anticorrosive material 10. The anticorrosive material 10 is an ultraviolet (UV) curing resin that is cured by radiation of ultraviolet rays, for example. Examples of the usable UV curing resin include urethane acrylate resins. The usable UV curing resin is not limited to those. The anticorrosive material 10, which is a pasty UV curing resin, is applied to a certain portion. Thereafter, the anticorrosive material 10 is irradiated with ultraviolet rays to be cured and holds its shape. The anticorrosive material 10 is provided across the conductor crimping portion 44, the intermediate portion 45, the cover crimping portion 46, and the conductor W1 exposed from the crimp terminal 1. The anticorrosive material 10 is provided across a distal end W1*b* of the conductor W1 exposed in the crimp terminal 1, the conductor crimping portion 44, the intermediate exposed portion W1*a* exposed in the intermediate portion 45, and the cover crimping portion 46 along the axial line direction X. The anticorrosive material 10 is provided in such a manner to permeate inside the electric wire crimping portion 4 and between the element wires of the conductor W1. The anticorrosive material 10 is applied to and permeates in the portions described above. Thereafter the anticorrosive material 10 is cured by being irradiated with ultraviolet rays to hold its shape, thereby covering the portions. This structure allows the crimp terminal 1 to stop water by the anticorrosive material 10 to prevent water (salt water) from intruding in the inside, thereby making it possible to prevent the occurrence of the galvanic corrosion, for example.

As illustrated in FIGS. 1, 2, 4, 5, and 6, in the terminal-equipped electric wire 100 in the embodiment, the intermediate portion 45 has the grooves 48 to make it easy to supply the anticorrosive material 10 to the inside of the electric wire crimping portion 4 in which the anticorrosive material 10 hardly permeates in a state after crimping of the crimp terminal 1.

Specifically, the grooves 48 are provided on the surface on the conductor W1 side (i.e., on an inner surface) of the intermediate portion 45. The grooves 48 are formed from both end portions in the circumferential direction D1 of the intermediate portion 45 such that each groove 48 is formed toward a center C side in the circumferential direction D1. The grooves 48 are formed in a recessed shape on the surface on the conductor W1 side of the intermediate portion 45 as a different portion from the serrations 47 formed on the conductor crimping portion 44.

The number of grooves 48 in the embodiment is six in total, that is, three grooves 48 are provided on the end portion on one side in the circumferential direction D1 of the intermediate portion 45 and three grooves 48 are provided on the end portion on the other side in the circumferential direction D1 of the intermediate portion 45. The multiple grooves 48 are provided on each end portion in the circumferential direction D1 of the intermediate portion 45 in such a manner to have an interval therebetween along the axial line direction X.

More specifically, the grooves 48 are formed on raised end portions 41*ba* raising along the height direction Z in the second base 41*b* forming the intermediate portion 45. The grooves 48 are formed in a manner different from that of the serrations 47. The grooves 48 is each formed in such a manner to extend from the end of the raised end portion 41*ba* in the circumferential direction D1 of the intermediate portion 45 along the circumferential direction D1, and to close at such a position that the end portion of the groove 48 on the center C side in the circumferential direction D1 is spaced apart from the center C in the circumferential direction D1 of the intermediate portion 45. In each groove 48, one end portion thereof opens along the circumferential direction D1 while the other end portion thereof closes at the position spaced apart from the center C in the circumferential direction D1. To say more precisely, the intermediate portion 45 in the embodiment is provided with the grooves 48 on the pair of raised end portions 41*ba* and a central portion between the pair of raised end portions 41*ba* is provided with no grooves 48, resulting in the central portion having a substantially flat surface. The grooves 48 are each formed along the width direction Y in a development state before crimping illustrated in FIG. 5, and extend along the circumferential direction D1 after crimping of the crimp terminal 1.

The grooves 48 are each positioned to be spaced apart from the cover crimping portion 46 along the axial line direction X. A distance L1 (refer to FIG. 5) between the groove 48 positioned nearest to the cover crimping portion 46 and the cover crimping portion 46 along the axial line direction X is preferably kept equal to or larger than 1 mm. This structure makes it possible for the crimp terminal 1 to prevent an end W2*a* of the insulating cover W2 from being on any of the grooves 48 in a state after crimping.

The grooves 48 is each formed such that a sectional shape intersecting the extending direction (refer to FIG. 6) is a substantially trapezoidal shape. The sectional shape of each groove 48 is not limited to the substantially trapezoidal shape. The sectional shape intersecting the extending direction may be a substantially rectangular shape or substantially semicircular shape, for example.

Figure 7:
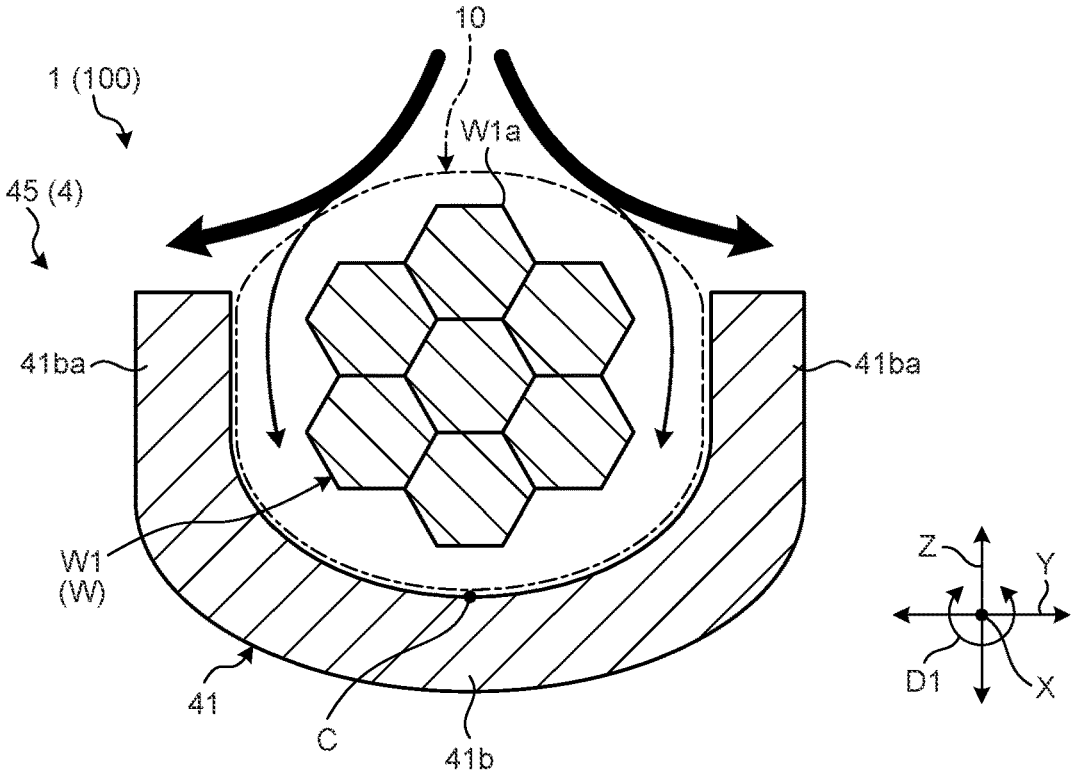
FIG. 7 is a schematic sectional view taken along C-C in FIG. 2.
Figure 8:
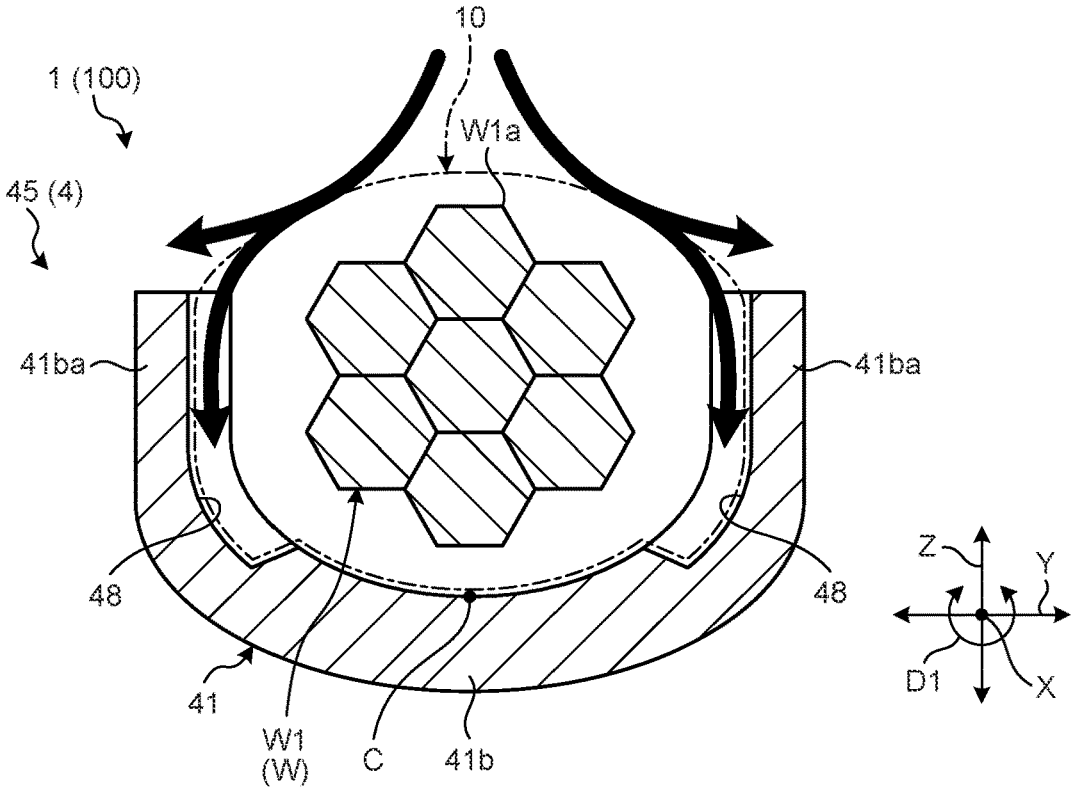
FIG. 8 is a schematic sectional view taken along D-D in FIG. 2.
Figure 9:
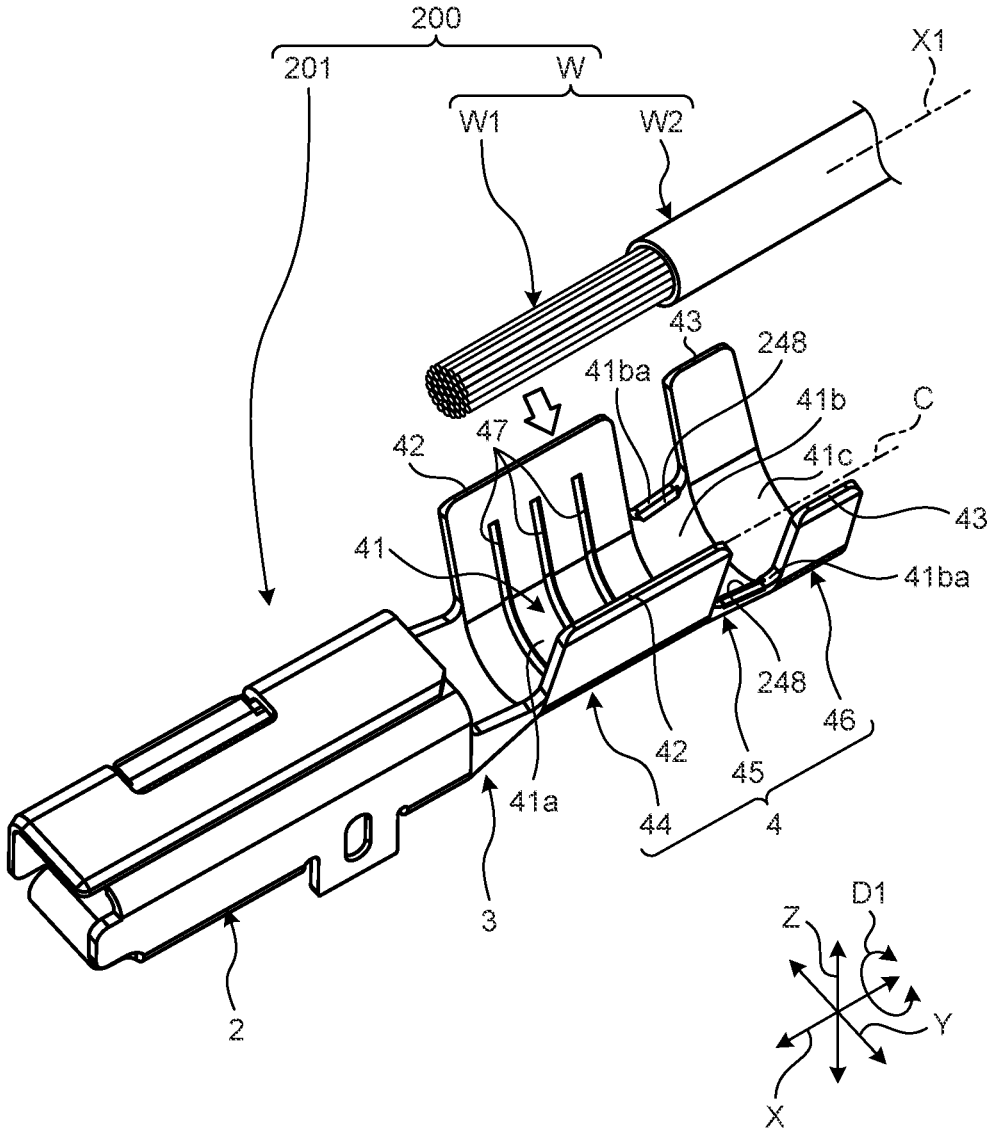
FIG. 9 is an exploded perspective view illustrating a rough structure of a terminal-equipped electric wire according to a second embodiment.
Figure 10:
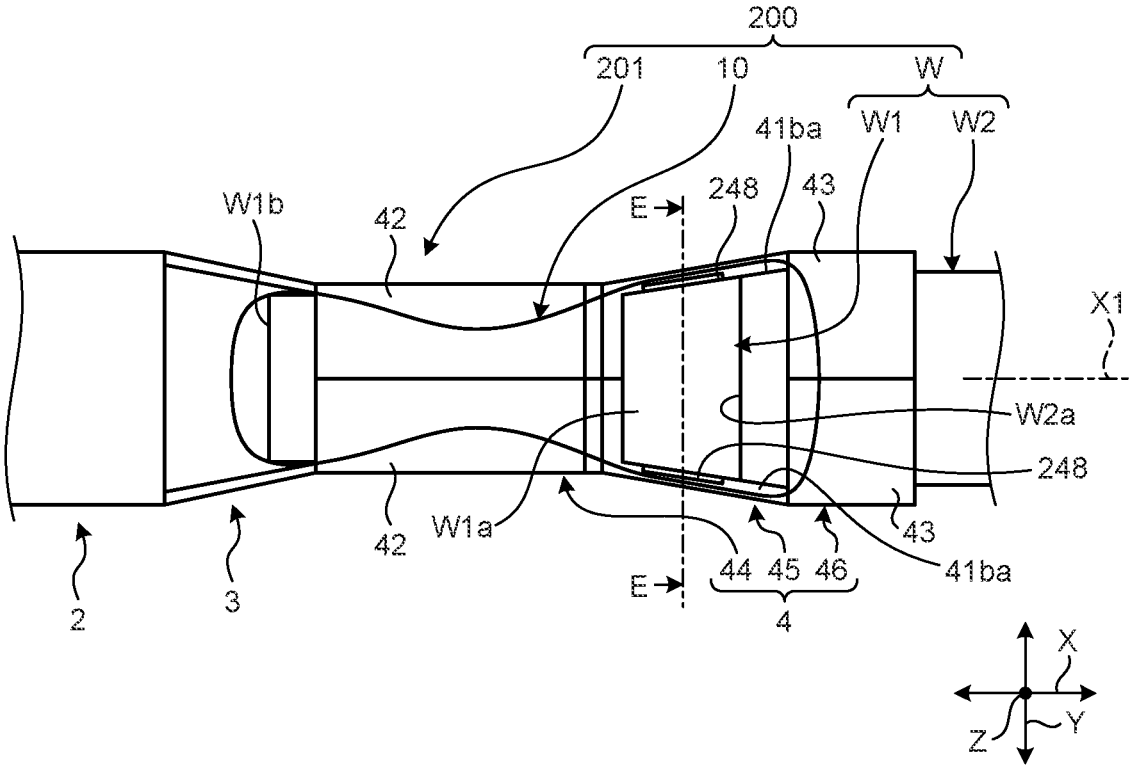
FIG. 10 is a schematic partial plan view illustrating the rough structure of the terminal-equipped electric wire according to the second embodiment.

The terminal-equipped electric wire 100 thus structured allows the anticorrosive material 10 to more easily permeate on the center C side in the circumferential direction D1 via the grooves 48 at the portion provided with the grooves 48 illustrated in FIG. 8 than the portion provided with no grooves 48 illustrated in FIG. 7 when the anticorrosive material 10 is applied to the intermediate portion 45. As a result, the terminal-equipped electric wire 100 can reliably supply the anticorrosive material 10 to a gap space 49 (refer to FIG. 3) that is formed inside the electric wire crimping portion 4 and to which the anticorrosive material 10 is hardly supplied from the outside in a state after crimping of the crimp terminal 1, for example.

The gap space 49 is a space surrounded by the crimp terminal 1, the conductor W1, and the end W2*a* of the insulating cover W2 in the inside of the crimp terminal 1 in a state where the crimp terminal 1 is crimped to the electric wire W (refer to FIG. 3). In a state where the crimp terminal 1 is crimped, the end W2*a* of the insulating cover W2 of the electric wire W is positioned between the conductor crimping portion 44 and the cover crimping portion 46, that is, in the intermediate portion 45. The gap space 49 is a gap formed between the inner surface of the second base 41*b* and the outer surface of the conductor W1 due to a step corresponding to the thickness of the end W2*a* of the insulating cover W2 in the inside of the crimp terminal 1. The gap space 49 is formed as a gap having a substantially arc shape along the step corresponding to the thickness of the end W2*a* of the insulating cover W2.

The multiple grooves 48 in the embodiment are positioned on both sides of the gap space 49 in the circumferential direction D1. The terminal-equipped electric wire 100 can also reliably supply the anticorrosive material 10 to the gap space 49 via each groove 48. As a result, the anticorrosive material 10 is fully filled in at least the gap space 49 surrounded by the intermediate portion 45, the conductor W1, and the end W2*a* of the insulating cover W2 in a state where the crimp terminal 1 is crimped to the electric wire W, and each groove 48.

FIGS. 7 and 8 illustrate that the anticorrosive material 10 is applied from immediately above the intermediate exposed portion W1*a* exposed in the intermediate portion 45 after crimping of the crimp terminal 1 and flows toward the grooves 48 on both sides in the width direction Y. The application-supply method is not limited to that illustrated in FIGS. 7 and 8. For example, the anticorrosive material 10 may be applied from immediately above the grooves 48 on one side in the width direction Y, flow toward the grooves 48 on the one side, and thereafter reach the grooves 48 on the other side to be supplied thereto.

In the terminal-equipped electric wire 100 described above, the conductor crimping portion 44 is crimped to the conductor W1, and the cover crimping portion 46 is crimped to the insulating cover W2, resulting in the crimp terminal 1 being crimped to the electric wire W. In such a structure, the crimp terminal 1 has the grooves 48 on the intermediate portion 45 that couples the conductor crimping portion 44 and the cover crimping portion 46. The grooves 48 are provided on the surface on the conductor W1 side of the intermediate portion 45. The grooves 48 are formed from both end portions (the raised end portions 41*ba*) in the circumferential direction D1 of the intermediate portion 45 such that each groove 48 is formed toward the center C side in the circumferential direction D1. This structure allows the terminal-equipped electric wire 100 to easily permeate the anticorrosive material 10 on the center C side in the circumferential direction D1 via the grooves 48 in the intermediate portion 45. In this case, the terminal-equipped electric wire 100 allows the grooves 48 not only to serve as a supply path guiding the anticorrosive material 10 to the center C side but also to serve as an air vent path venting air stored on the center C side to the outside. The grooves 48 are each used both as the supply path to supply the anticorrosive material 10 to the inside and as the air vent path to vent air to the outside. As a result, the terminal-equipped electric wire 100 can prevent mixing of air bubbles in the anticorrosive material 10.

The terminal-equipped electric wire 100 can reliably cover the conductor W1 exposed in the intermediate portion 45 with the anticorrosive material 10. As a result, the terminal-equipped electric wire 100 reliably covers the whole periphery of the conductor W1 inside the crimp terminal 1 to stop water, thereby making it possible to reliably prevent intrusion of moisture and the like between the conductor W1 and the crimp terminal 1. For example, when the material of the conductor W1 is aluminum and the material of the crimp terminal 1 is copper, and water intrudes therebetween, the terminal-equipped electric wire 100 has a risk of the conductor W1 being corroded (the galvanic corrosion) due to a difference in ionization tendency. The terminal-equipped electric wire 100, however, prevents the intrusion of water as described above, thereby making it possible to prevent the occurrence of the corrosion. As a result, the terminal-equipped electric wire 100 can improve anticorrosion reliability to ensure appropriate anticorrosion performance.

The terminal-equipped electric wire 100 has the grooves 48 serving as the supply path guiding the anticorrosive material 10 on the center C side, thereby making it possible to reduce a time period necessary for the anticorrosive material 10 to reach the inside of the electric wire crimping portion 4 and cover the conductor W1 and the like. As a result, the terminal-equipped electric wire 100 can reduce a takt time in manufacturing processes. For example, the terminal-equipped electric wire 100 can reduce a manufacturing cost.

In the terminal-equipped electric wire 100, the grooves 48 each extend from the end portion (the raised end portion 41*ba*) in the circumferential direction D1 of the intermediate portion 45 along the circumferential direction D1, and close at such a position that the end portion of the groove 48 on the center C side in the circumferential direction D1 is spaced apart from the center C in the circumferential direction D1. This structure allows the terminal-equipped electric wire 100 to have a substantially flat surface in the vicinity of the central portion of the intermediate portion 45, the central portion corresponding to the far side in the circumferential direction D1, in the inside of the crimp terminal 1. As a result, this structure allows air bubbles to be hardly stored in the anticorrosive material 10 on the far side in the circumferential direction D1. The terminal-equipped electric wire 100 can more reliably prevent intrusion of air bubbles in the anticorrosive material 10 and ensure the more appropriate anticorrosion performance.

The terminal-equipped electric wire 100 has the grooves 48 each positioned to be spaced apart from the cover crimping portion 46 along the axial line direction X. This structure allows the terminal-equipped electric wire 100 to prevent the end W2*a* of the insulating cover W2 from being on any of the grooves 48 in a state after crimping of the crimp terminal 1. The terminal-equipped electric wire 100 can prevent the insulating cover W2 from impairing the function of each groove 48. As a result, the terminal-equipped electric wire 100 can more reliably ensure the appropriate anticorrosion performance.

In the terminal-equipped electric wire 100, the grooves 48 each provided on the intermediate portion 45 allow the anticorrosive material 10 to be reliably supplied to the gap space 49 inside the crimp terminal 1 and the like, the gap space 49 to which the anticorrosive material 10 being hardly applied after crimping of the crimp terminal 1. The terminal-equipped electric wire 100 can reliably fill the anticorrosive material 10 in the gap space 49 and each groove 48, thereby making it possible to reliably stop water. As a result, the terminal-equipped electric wire 100 can ensure the appropriate anticorrosion performance as described above.

Second Embodiment

A terminal-equipped electric wire according to a second embodiment differs from the first embodiment in that the shape of the grooves differs from that of the first embodiment. In the following description, the same constituent elements as the first embodiment are provided with common numerals and duplicated descriptions of the structures, operations, and effects in common are omitted as much as possible.

A terminal-equipped electric wire 200 in the second embodiment illustrated in FIGS. 9, 10, 11, 12, and 13 differs from the terminal-equipped electric wire 100 in that the terminal-equipped electric wire 200 has a crimp terminal 201 instead of the crimp terminal 1. The crimp terminal 201 differs from the crimp terminal 1 in that the intermediate portion 45 has grooves 248 instead of the grooves 48. The other structures of the terminal-equipped electric wire 200 and the crimp terminal 201 are substantially the same as those of the terminal-equipped electric wire 100 and the crimp terminal 1.

Specifically, the grooves 248 are provided on the surface on the conductor W1 side (i.e., the inner surface) of the intermediate portion 45 in the same manner as the grooves 48. The grooves 248 are formed from both end portions in the circumferential direction D1 of the intermediate portion 45 such that each groove 248 is formed toward the center C side in the circumferential direction D1. The grooves 248 are formed in a recessed shape on the surface on the conductor W1 side of the intermediate portion 45 as a different portion from the serrations 47 formed on the conductor crimping portion 44.

The number of grooves 248 in the embodiment is two in total. One groove 248 is provided on the raised end portion 41*ba* on one side of the intermediate portion 45. The other groove 248 is provided on the raised end portion 41*ba* on the other side of the intermediate portion 45. The grooves 248 are each formed in such a manner to extend from the end of the raised end portion 41*ba* in the circumferential direction D1 of the intermediate portion 45 along the circumferential direction D1 and close at such a position that the end portion of the groove 248 on the center C side in the circumferential direction D1 is spaced apart from the center C in the circumferential direction D1 in the same manner as the grooves 48. The grooves 248 in the embodiment are each formed such that the length along the axial line direction X is relatively longer and the length along the circumferential direction D1 is relatively shorter than those of the groove 48.

Figure 11:
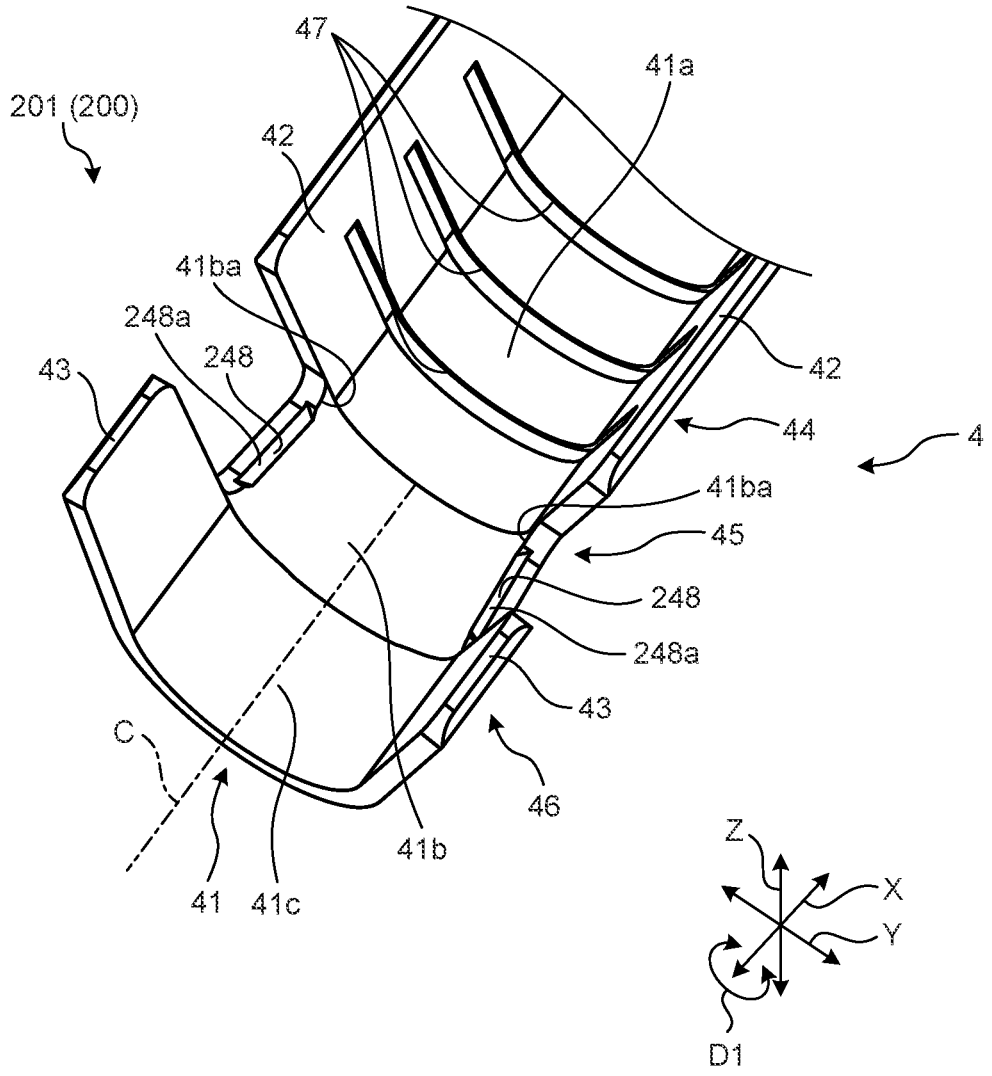
FIG. 11 is a partial perspective view including grooves of a crimp terminal included in the terminal-equipped electric wire according to the second embodiment.
Figure 12:
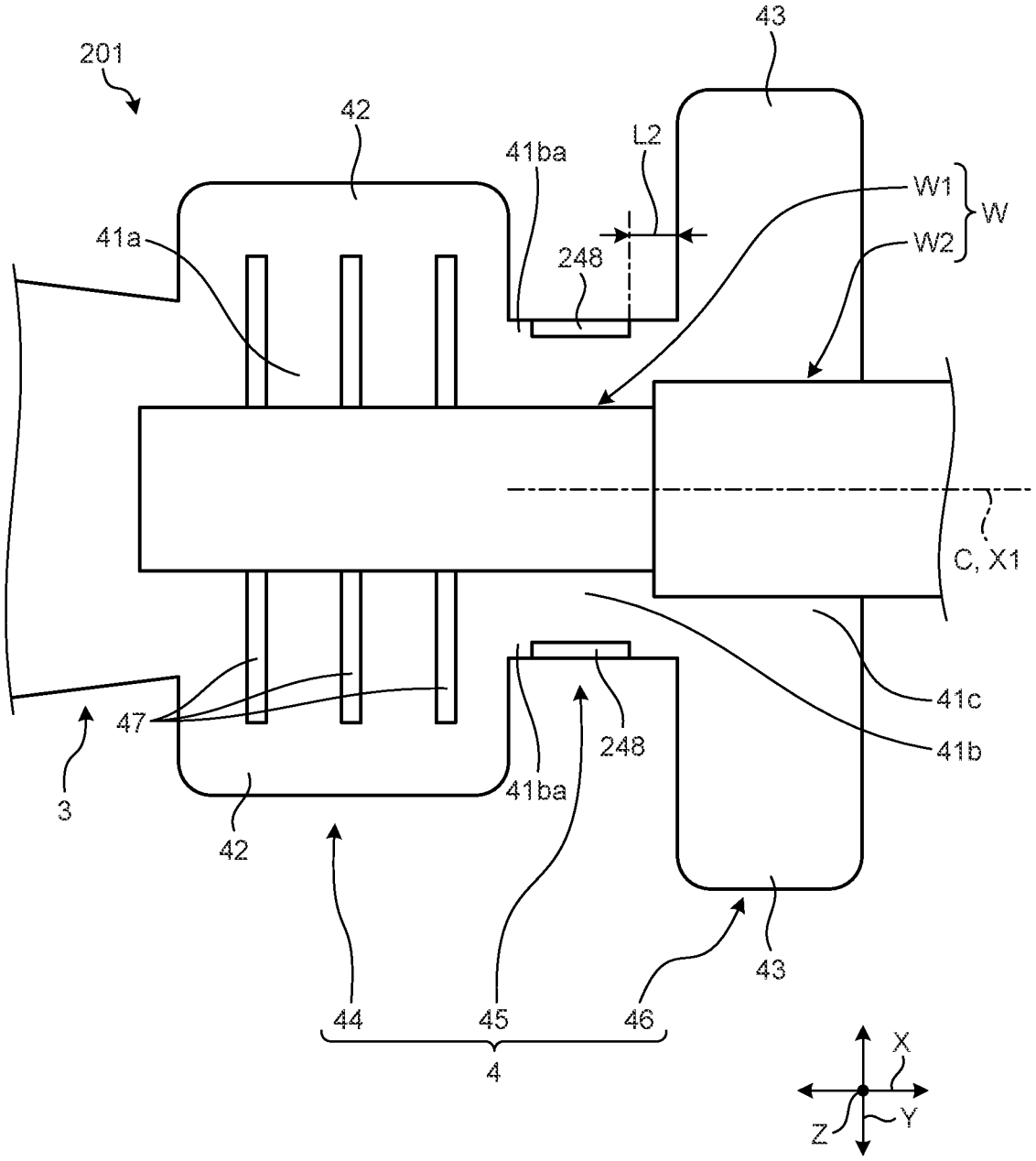
FIG. 12 is a schematic partial plan view of the crimp terminal included in the terminal-equipped electric wire according to the second embodiment in a development state before crimping.
Figure 13:
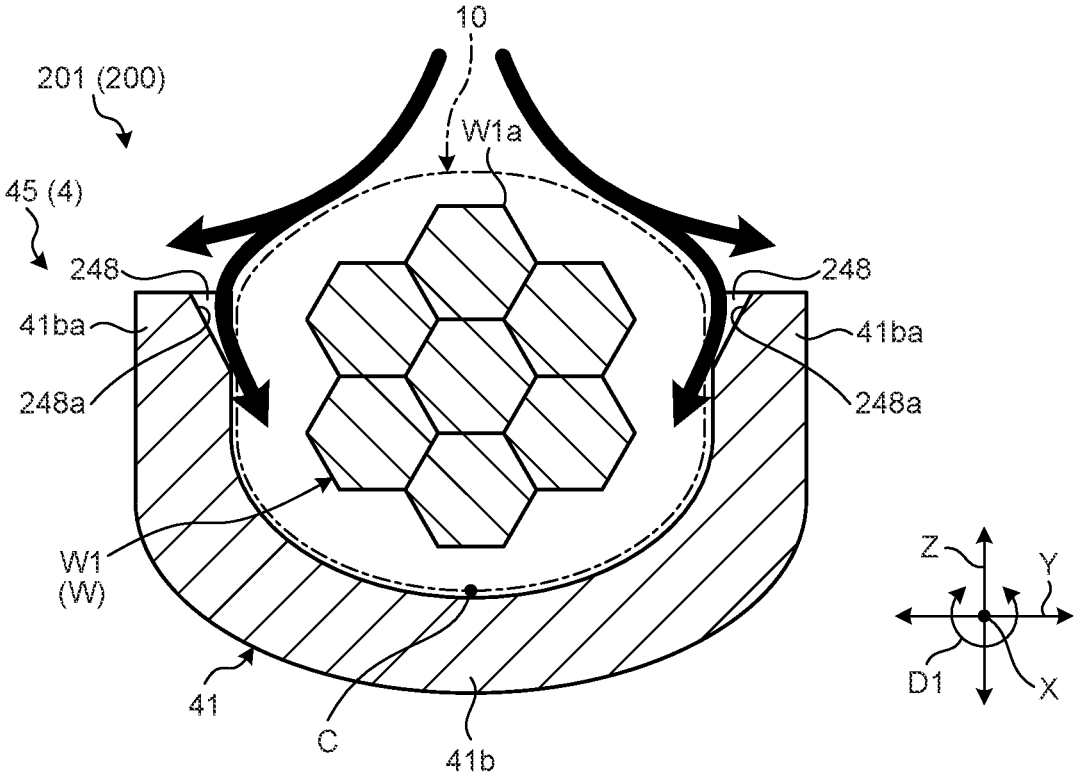
FIG. 13 is a schematic sectional view taken along E-E in FIG. 10.

The grooves 248 in the embodiment are each formed in a tapered shape toward the center C side in the circumferential direction D1 (refer to FIGS. 11 and 13, for example). More specifically, in each groove 248, the surface on the conductor W1 side (i.e., the inner surface) of the distal end of the raised end portion 41*ba* is chamfered to be formed as an inclined surface 248*a* inclined toward the center C side in the circumferential direction D1. The grooves 248 are each formed in a tapered shape toward the center C side in the circumferential direction D1 as a result of the surface on the conductor W1 side being chamfered to be formed as the inclined surface 248*a*. As a result, the grooves 248 are each formed on the surface on the conductor W1 side of the intermediate portion 45 in a recessed shape.

The grooves 248 are each positioned to be spaced apart from the cover crimping portion 46 along the axial line direction X in the same manner as the grooves 48. A distance L2 (refer to FIG. 12) between the groove 248 and the cover crimping portion 46 along the axial line direction X is preferably kept equal to or larger than 1 mm. This structure makes it possible for the crimp terminal 201 to prevent the end W2*a* of the insulating cover W2 from being on any of the grooves 248 in a state after crimping in the same manner as the crimp terminal 1.

The terminal-equipped electric wire 200 can ensure the appropriate anticorrosion performance in the same manner as the terminal-equipped electric wire 100.

When the anticorrosive material 10 is applied to the intermediate portion 45, as illustrated in FIG. 13, the terminal-equipped electric wire 200 allows the anticorrosive material 10 to easily permeate on the center C side in the circumferential direction D1 via the grooves 248 formed in a tapered shape toward the center C side in the circumferential direction D1. As a result, the terminal-equipped electric wire 200 can reliably supply the anticorrosive material 10 to the gap space 49 (refer to FIG. 3) that is formed inside the electric wire crimping portion 4 and to which the anticorrosive material 10 is hardly supplied from the outside in a state after crimping of the crimp terminal 1, for example, in the same manner as the terminal-equipped electric wire 100. As a result, the terminal-equipped electric wire 200 can ensure the appropriate anticorrosion performance as described above.

The terminal-equipped electric wires according to the embodiments of the invention are not limited to the embodiments described above. Various modifications can be made on them within the scope described in the claims.

In the above explanation, the grooves 48 and 248 are described as being each formed in such a manner to extend from the raised end portion 41*ba* in the circumferential direction D1 of the intermediate portion 45 along the circumferential direction D1 and close at such a position that the end portion thereof on the center C side in the circumferential direction D1 is spaced apart from the center C in the circumferential direction D1. The grooves 48 and 248 are not limited to being formed in such a manner. The grooves 48 and 248 may be each formed continuously across the pair of raised end portions 41*ba* and the central portion between the pair of raised end portions 41*ba* in the intermediate portion 45. The grooves 48 and 248 may be each formed in such a manner that one provided on the raised end portion 41*ba* on one side and one provided on the raised end portion 41*ba* on the other side communicate at the central portion to continue each other.

In the explanation described above, the anticorrosive material 10 is a UV curing resin. The anticorrosive material 10 is not limited to the UV curing resin. The anticorrosive material 10 may be a thermosetting resin cured by applied heat, for example.

The terminal-equipped electric wires according to the embodiments may be achieved by appropriately combining the embodiments described above and constituent elements of modifications.

In the terminal-equipped electric wire according to the embodiment, the crimp terminal is crimped to the electric wire as a result of the conductor crimping portion being crimped to the conductor and the cover crimping portion being crimped to the insulating cover. In such a structure, the crimp terminal has the grooves on the intermediate portion that couples the conductor crimping portion and the cover crimping portion. The grooves are provided on the surface on the conductor side of the intermediate portion and are each formed from both end portions in the circumferential direction of the intermediate portion such that each groove is formed toward the center side in the circumferential direction. This structure allows the terminal-equipped electric wire to cause the anticorrosive material to easily permeate on the center side in the circumferential direction via the grooves on the intermediate portion, thereby making it possible to reliably cover the conductor exposed in the intermediate portion with the anticorrosive material. As a result, the terminal-equipped electric wire has an advantageous effect of capable of ensuring the appropriate anticorrosion performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal-equipped electric wire, comprising:

an electric wire in which a conductor having conductivity is covered by an insulating cover having insulation property;

a crimp terminal including a conductor crimping portion crimped to the conductor exposed from an end of the insulating cover, a cover crimping portion crimped to the insulating cover, and an intermediate portion that couples the conductor crimping portion and the cover crimping portion and in which the conductor is exposed; and an anticorrosive material covering at least the conductor exposed in the intermediate portion, wherein the intermediate portion has grooves that are provided on a surface on the conductor side and formed from both end portions in a circumferential direction around an axial line of the electric wire such that each of the grooves is formed toward a center side in the circumferential direction, and the grooves extend from the end portion in the circumferential direction of the intermediate portion along the circumferential direction and close at such a position that an end portion on the center side in the circumferential direction is positioned to be spaced apart from the center in the circumferential direction.

2. The terminal-equipped electric wire according to claim 1, wherein the grooves are formed in a tapered shape toward the center side in the circumferential direction.

3. The terminal-equipped electric wire according to claim 2, wherein the grooves are positioned to be apart from the cover crimping portion along the axial line direction of the electric wire.

4. The terminal-equipped electric wire according to claim 3, wherein the anticorrosive material is filled in at least a gap space surrounded by the intermediate portion, the conductor, and the end of the insulating cover in a state where the crimp terminal is crimped to the electric wire, and the groove.

5. The terminal-equipped electric wire according to claim 2, wherein the anticorrosive material is filled in at least a gap space surrounded by the intermediate portion, the conductor, and the end of the insulating cover in a state where the crimp terminal is crimped to the electric wire, and the groove.

6. The terminal-equipped electric wire according to claim 1, wherein the grooves are positioned to be apart from the cover crimping portion along the axial line direction of the electric wire.

7. The terminal-equipped electric wire according to claim 6, wherein the anticorrosive material is filled in at least a gap space surrounded by the intermediate portion, the conductor, and the end of the insulating cover in a state where the crimp terminal is crimped to the electric wire, and the groove.

8. The terminal-equipped electric wire according to claim 1, wherein the anticorrosive material is filled in at least a gap space surrounded by the intermediate portion, the conductor, and the end of the insulating cover in a state where the crimp terminal is crimped to the electric wire, and the groove.

* * * * *